US008168712B2

(12) United States Patent
Tarao

(10) Patent No.: US 8,168,712 B2
(45) **Date of Patent: *May 1, 2012**

(54) GOLF BALL

(75) Inventor: Toshiyuki Tarao, Kobe (JP)

(73) Assignee: SRI Sports Limited, Kobe (JP)

( * ) Notice: Subject to any disclaimer, the term of this patent is extended or adjusted under 35 U.S.C. 154(b) by 397 days.

This patent is subject to a terminal disclaimer.

(21) Appl. No.: 12/422,505

(22) Filed: Apr. 13, 2009

(65) Prior Publication Data

US 2009/0264223 A1 Oct. 22, 2009

(30) Foreign Application Priority Data

Apr. 21, 2008 (JP) ..... 2008-110385

(51) Int. Cl.
*A63B 37/12* (2006.01)
*A63B 37/00* (2006.01)
*C08L 33/02* (2006.01)

(52) U.S. Cl. ..... 524/445; 524/444; 524/447; 473/378; 473/385

(58) Field of Classification Search ..... None
See application file for complete search history.

(56) References Cited

U.S. PATENT DOCUMENTS

| | | | | |
|---|---|---|---|---|
| 5,692,974 | A | 12/1997 | Wu et al. | |
| 5,851,245 | A | 12/1998 | Moriyama et al. | |
| 6,051,643 | A * | 4/2000 | Hasegawa et al. | 524/445 |
| 6,688,992 | B2 | 2/2004 | Takemura et al. | |
| 6,794,447 | B1 | 9/2004 | Kim et al. | |
| 7,066,836 | B2 * | 6/2006 | Hayashi | 473/373 |
| 7,332,533 | B2 | 2/2008 | Kim et al. | |
| 7,943,689 | B2 | 5/2011 | Shiga et al. | |
| 2002/0045501 | A1 | 4/2002 | Takemura et al. | |
| 2004/0048129 | A1 | 3/2004 | Taft, III et al. | |
| 2004/0092336 | A1 | 5/2004 | Kim et al. | |
| 2005/0059756 | A1 | 3/2005 | Kim et al. | |
| 2005/0228140 | A1 | 10/2005 | Rajagopalan et al. | |
| 2006/0009308 | A1 | 1/2006 | Isogawa et al. | |
| 2006/0009585 | A1 * | 1/2006 | Fujisawa et al. | 525/221 |
| 2006/0128867 | A1 | 6/2006 | Marx et al. | |
| 2006/0137797 | A1 * | 6/2006 | Galimberti et al. | 152/537 |
| 2006/0235128 | A1 | 10/2006 | Wang et al. | |
| 2008/0214326 | A1 | 9/2008 | Kim et al. | |
| 2008/0293518 | A1 | 11/2008 | Shiga et al. | |
| 2009/0197706 | A1 * | 8/2009 | Yamada et al. | 473/378 |
| 2010/0331115 | A1 | 12/2010 | Shiga et al. | |

FOREIGN PATENT DOCUMENTS

| | | | |
|---|---|---|---|
| JP | 8-302068 | A | 11/1996 |
| JP | 9-124836 | A | 5/1997 |
| JP | 9-183910 | A | 7/1997 |
| JP | 10-168305 | A | 6/1998 |
| JP | 2002-136618 | A | 5/2002 |
| JP | 2002-539905 | A | 11/2002 |
| JP | 2003-511116 | A | 3/2003 |
| JP | 2004-504900 | A | 2/2004 |
| JP | 2005-28153 | A | 2/2005 |
| JP | 2005-106859 | A | 4/2005 |
| JP | 2006-43447 | A | 2/2006 |
| JP | 2006-346015 | A | 12/2006 |
| JP | 2006346014 | * | 12/2006 |
| JP | 2008-289674 | A | 12/2008 |
| KR | 10-2005-0112693 | A | 12/2005 |
| WO | WO 00/57962 | A1 | 10/2000 |
| WO | WO 01/24888 | A1 | 4/2001 |

OTHER PUBLICATIONS

Shah; Nanocomposites from poly(ethylene-co-methacrylic acid) ioomers; Polymer 46 (2005) pp. 2646-2662.*

Laviosa Chimica Mineraria product literature for DELLITE 67G (no date).*

Toprak, A New Route to the Synthesis of Nanocomposites by Using an Unsaturated Polyester Matrix; Thesis submitted to the Graduate School of Natural and Applied Sciences of Middle East Technical University; Sep. 2004.*

Choi et al., "Synthesis of chain-extended organifier and properties of polyurethane/clay nanocomposites", Polymer, vol. 45, 2004, pp. 6045-6057.

English language Japanese Office Action for Application No. 2009-154269 dated Jul. 26, 2011.

Inagaki et al., "Synthesis and characterization of highly ordered mesoporous material; FSM-16, from a layered polysilicate", Studies in Surface Science and Catalysis, vol. 84, 1994, pp. 125-132.

Inagaki et al., "Synthesis of New Mesoporous Material by Folding Silicate Sheets", Science and Technology in Catalysis, 1994, pp. 143-148.

Japanese Office Action for Application No. 2007-138441 dated Apr. 28, 2009, with English translation.

Nanocor, "Nylon Nanocomposites Using Nanomer® I.24TL Nanoclay", Lit N-609 (Oct. 2004), 2 pages.

U.S. Office Action for U.S. Appl. No. 12/153,682 dated Sep. 17, 2010.

U.S. Office Action for U.S. Appl. No. 12/363,368 dated Sep. 21, 2011.

U.S. Office Action for U.S. Appl. No. 12/422,392 dated Aug. 10, 2011.

* cited by examiner

*Primary Examiner* — David Buttner
(74) *Attorney, Agent, or Firm* — Birch, Stewart, Kolasch & Birch, LLP

(57) ABSTRACT

The object of the present invention is to provide a golf ball having excellent durability and resilience. The present invention provides a golf ball which includes a core, and a cover covering the core. The cover contains an ionomer resin and an organically modified layered silicate. The organically modified layered silicate has an interlayer distance, measured by X-ray diffraction, in a range from 2.5 nm to 15 nm.

13 Claims, No Drawings

GOLF BALL

FIELD OF THE INVENTION

The present invention relates to a golf ball that has excellent durability and resilience.

DESCRIPTION OF THE RELATED ART

Ionomer resins are widely used as a resin component of a cover of a golf ball, because of their excellent resilience. In order to further improve the resilience of these ionomer resins, it is preferable to make the hardness and rigidity higher, but the cover having the high hardness and rigidity tends to crack during the repeated shots, and the problem has been pointed out that the ionomer resins have an inferior durability.

There are proposals to improve characteristics of a cover by blending fillers made of organic short fibers, glass, metal, clay minerals, or the like into a resin component of a cover. For example, Japanese Patent Publication No. 2004-504900 T (patent document 1) discloses a golf ball containing a nanocomposite material that is made of a polymer having a structure in which particles of inorganic materials are reacted and substantially evenly dispersed, in which each particle has a largest dimension that is about one micrometer or less and that is at least an order of magnitude greater than such particle's smallest dimension. Further, Japanese Patent Publication No. 2006-43447 A (patent document 2) discloses a golf ball including a core and an outer layer portion surrounding the core, wherein the outer layer portion is made of a resin composition that contains cation treated layered silicates in a resin matrix.

SUMMARY OF THE INVENTION

However, the golf balls described in patent documents 1 and 2 leave potential for improving durability and resilience of a golf ball.

The present invention has been made in view of the above problems, and the object of the present invention is to provide a golf ball having excellent durability and resilience.

A golf ball of the present invention that can solve the above problems is a golf ball comprising a core and a cover that covers the core, wherein the cover contains an ionomer resin and an organically modified layered silicate, and an interlayer distance of the organically modified layered silicate measured by X-ray diffraction is in a range from 2.5 nm to 15 nm.

The dispersibility of a layered silicate in an ionomer resin which is a resin component may be enhanced by organically modifying a layered silicate surface. Furthermore, in the present invention, an organically modified layered silicate contained in a cover is not single-leaf state. Instead, an interlayer distance of the organically modified layered silicate in the cover, measured by X-ray diffraction, is adjusted in a range from 2.5 nm to 15 nm, by adjusting an amount of extension of the interlayer distance of the organically modified layered silicate when mixing the organically modified layered silicate and the ionomer resin, or when molding the cover. When compared to a case in which organically modified layered silicate is single-sheeted, durability and resilience of a golf ball can be improved by the adjustment.

The reason is not clear why durability and resilience of a golf ball improves when the interlayer distance of the organically modified layered silicate contained in a golf ball cover is adjusted in the above-described range, rather than when the organically modified layered silicate is single-leaf state. However, it is presumed that the reason is because when the interlayer distance of the organically modified layered silicate in the cover is adjusted in a range from 2.5 nm to 15 nm, the ionomer resin is tucked in an interlayer of the organically modified layered silicate in the cover, and an interaction between the ionomer resin and the organically modified layered silicate increases, and leads to a strong reinforcement effect of the cover by the organically modified layered silicate.

The melt flow rate (190° C., 2.16 kg) of the ionomer resin is preferably in a range from 0.5 g/10 min to 15 g/10 min.

The amount of the organically modified layered silicate in the cover is preferably in a range from 0.01 to 10 parts by mass per 100 parts by mass of the ionomer resin. A layered silicate that is organically modified by an organic ammonium ion is preferably used as the organically modified layered silicate.

The slab hardness of the cover is preferably in a range from 40 to 80 in Shore D hardness.

A manufacturing method for the golf ball of the present invention includes: an organic modification process of organically modifying a layered silicate by using an organic cation to manufacture an organically modified layered silicate; and a cover molding process of forming a cover such that the organically modified layered silicate in the cover has an interlayer distance measured by X-ray diffraction in a range from 2.5 nm to 15 nm, by using the organically modified layered silicate, an ionomer resin, and an additive. Adopting this manufacturing method allows a cover, which has an interlayer distance of the organically modified layered silicate measured by X-ray diffraction in a range from 2.5 nm to 15 nm, to be easily molded.

The golf ball manufacturing method of the present invention preferably comprises a nanocomposite process of mixing the organically modified layered silicate and the ionomer resin before the cover molding process to prepare a nanocomposite having an interlayer distance of a layered silicate in a range from 2.0 nm to 15 nm.

A twin-screw extruder is preferably used in the nanocomposite process for mixing the organically modified layered silicate and the ionomer resin, using a mixing condition of a mixing temperature in a range from 140° C. to 220° C. Furthermore, mixing of the nanocomposite and the additive, and injection-molding of the cover, both of which in the cover molding process are preferably conducted by using a twin-screw extruder at mixing temperature in a range from 140° C. to 220° C.

According to the present invention, a golf ball having excellent durability and resilience is achieved.

BEST MODE FOR CARRYING OUT THE INVENTION

The present invention provides a golf ball comprising a core and a cover that covers the core, wherein the cover contains an ionomer resin and an organically modified layered silicate, and an interlayer distance of the organically modified layered silicate measured by X-ray diffraction is in a range from 2.5 nm to 15 nm.

The interlayer distance of the organically modified layered silicate in the cover, measured by X-ray diffraction, is 2.5 nm or more, and preferably 2.6 nm or more, and even more preferably 2.7 nm or more, and 15 nm or less, and preferably 14.5 nm or less, and more preferably 14.0 nm or less. Adjusting the interlayer distance of the organically modified layered silicate in the cover in a range from 2.5 nm to 15 nm allows enhancement of a cover reinforcement effect by the organically modified layered silicate, thereby improving durability and resilience of the cover. The interlayer distance of the organically modified layered silicate in the cover described in the present application, is an interlayer distance obtained by X-ray diffraction measurement of an organically modified layered silicate contained in a sheet that is molded in a sheet form with a cover composition and at an injection condition similar to a cover molding condition. The X-ray diffraction measurement is conducted by a later described measuring method.

The interlayer distance measured by X-ray diffraction in the present invention is an interlayer distance (d) value derived by the Bragg's equation (the following Formula 1) using a peak position ($\theta_m$) of a primary peak in a spectrum obtained by X-ray diffraction measurement.

[Formula 1]

$$d=\lambda/2 \sin \theta_m \quad (1)$$

d: Interlayer distance (nm)

$\theta_m$: peak position of primary peak (°)

$\lambda$: wavelength of X-ray source (nm)

In other words, an interlayer distance (d) measured by X-ray diffraction being in a range from 2.5 nm to 15 nm means, for example, when measurement is conducted with CuKα radiation ($\lambda$=0.15418 nm) as an X-ray, a primary peak ($\theta_m$) among the obtained X-ray spectrum is in a position of 0.294° to 1.77°.

Described next is the organically modified layered silicate used in the cover. The organically modified layered silicate is a layered silicate, in which a part or all of the metallic cations that are intrinsically contained within a layered silicate crystal interlayer are exchanged with organic cations. In the following descriptions, a layered silicate that is not organically modified is simply referred to as a "layered silicate", and a layered silicate that is organically modified is called an "organically modified layered silicate".

The layered silicate is not limited to one form, as long as it is a silicate that has a layered structure. Examples are: layered silicates of kaolinites such as kaolinite, dickite, halloysite, chrysotile, lizardite, and amesite; layered silicates of smectites such as montmorillonite, beidellite, nontronite, saponite, ferrous saponite, hectorite, sauconite, and stevensite; layered silicates of vermiculites such as dioctahedral vermiculite, and trioctahedral vermiculite; layered silicates of micas such as muscovite, paragonite, phlogopite, biotite, and lepidolite; layered silicates of brittle micas such as margarite, clintonite, and anandite; layered silicates of chlorites such as cookeite, sudoite, clinochlore, chamosite, and nimite. These layered silicates may be natural or synthetic in origin, and may be used independently or as a mixture of two or more types. Among these, layered silicates of smectites such as montmorillonite, beidellite, nontronite, saponite, ferrous saponite, hectorite, sauconite, and stevensite; and layered silicates of vermiculites such as dioctahedral vermiculite, and trioctahedral vermiculite; are preferred as a layered silicate to be used in the present invention. Among these, montmorillonite is especially preferred.

Each layer (primary particle) that constructs the layered silicate is preferably a nano size fine particle with a thickness of 10 nm or less, and preferably has a flat shape with a length of 1 μm or less, and a width of 1 μm or less. There is no limit to the size of the layered silicate, however, the size is preferably 1 μm or less, and more preferably 700 nm or less, and even more preferably 500 nm or less.

A cation exchange capacity of the layered silicate is preferably 30 meq/100 g or more, and more preferably 40 meq/100 g or more, and even more preferably 50 meq/100 g or more, and preferably 200 meq/100 g or less, and more preferably 180 meq/100 g or less, and even more preferably 160 meq/100 g or less. If the cation exchange capacity is 30 meq/100 g or more, a sufficient exchange of an organic cation is achieved during organic modification, and the interlayer distance may be widened to a desired width. If the cation exchange capacity is 200 meq/100 g or less, bonding force in the crystal interlayer is not excessively strong, and the interlayer distance may be easily widened. The cation exchange capacity is the total amount of exchangeable cation contained in a layered silicate with respect to unit mass of the layered silicate.

An organic cation used during organic modification of the layered silicate is a cation that has a carbon chain. The organic cation is not limited to one type, and examples include an organic ammonium ion, an organic phosphonium ion, and an organic sulfonium ion.

The carbon number of the carbon chain included in the organic cation is preferably 3 or more, and more preferably 4 or more, and even more preferably 5 or more, and preferably 50 or less, and more preferably 40 or less, and even more preferably 30 or less. If the carbon number of the carbon chain included in the organic cation is in a range from 3 to 50 inclusive, the interlayer distance of the layered silicate may be widened to a desired width during organic modification. The interlayer distance of the organically modified layered silicate is decided basically by the length of the carbon chain included in the organic cation, and therefore, the carbon number of the carbon chain included in the organic cation may be altered as appropriate, depending on the desired interlayer distance.

Examples of the organic ammonium ion include: primary ammonium ions, such as stearyl ammonium ion, hexyl ammonium ion, octyl ammonium ion, and 2-ethyl hexyl ammonium ion; secondary ammonium ions such as dodecyl (lauryl)ammonium ion, and octadecyl(stearyl)ammonium ion; tertiary ammonium ions such as trioctyl ammonium ion; and quaternary ammonium ions such as dioctyl dimethyl ammonium ion, and distearyl dimethyl ammonium ion. Examples of the organic phosphonium ion include stearyl phosphonium ion and the like. Examples of the organic sulfonium ion include stearyl sulfonium ion and the like. These organic cations may be used independently, or in combination of two or more types. Among these organic cations, as the organic cation used in the present invention, an organic ammonium ion is preferred, and a primary ammonium ion is more preferred, and stearyl ammonium ion is especially preferred.

A salt of the organic cation may be used as a source of the organic cation. For example, when stearyl ammonium is used as the organic cation, stearylamine hydrochloride may be used as a source, and when distearyl dimethyl ammonium is used as the organic cation, distearyl dimethyl ammonium chloride may be used as a source. The method for organic modification is described later.

An ion exchange rate of the organically modified layered silicate is preferably 50 mol % or higher, and more preferably 60 mol % or higher, and even more preferably 70 mol % or higher. If the ion exchange rate of the organically modified layered silicate is 50 mol % or higher, the dispersibility of the organically modified layered silicate in the ionomer resin is improved. Here, an ion exchange rate of the organically modified layered silicate is, a ratio (percentage) of an amount of cations that are exchanged with an organic cation, to the total amount of exchangeable cations contained within a layered silicate before organic modification.

Furthermore, an interlayer distance of the organically modified layered silicate at a moment immediately after organic modification, that is, before being mixed with the ionomer resin, is preferably 1.5 nm or more, and more preferably 1.8 nm or more, and even more preferably 2.0 nm or more, and preferably 15 nm or less, and more preferably 14.5 nm or less, and even more preferably 14.0 nm or less. If the interlayer distance of the organically modified layered silicate before being mixed with the ionomer resin is 1.5 nm or more, the ionomer resin can easily be incorporated in the interlayer of the organically modified layered silicate. This eliminates the need for a process such as dissolving each of the ionomer resin and the organically modified layered silicate in solvents to obtain solutions thereof, and mixing the two solutions; but instead, just mixing the ionomer resin and the organically modified layered silicate by an extruder allows insertion of the ionomer resin into the interlayer of the organically modified layered silicate. Furthermore, if the interlayer distance of the organically modified layered silicate before being mixed with the ionomer resin is 15 nm or less, single-sheeting of the organic layered silicate, during mixing of the ionomer resin and the organically modified layered silicate, can be suppressed.

Described next is the ionomer resin used in the cover as a resin component.

The ionomer resin is a polymer in which at least a part of acidic groups thereof are neutralized with a metal ion.

The ionomer resin is not limited, examples include an ionomer resin obtained by neutralizing at least a part of carboxyl groups in a binary copolymer of ethylene and an α,β-unsaturated carboxylic acid having 3 to 8 carbon atoms with a metal ion; an ionomer resin obtained by neutralizing at least a part of carboxyl groups in a ternary copolymer of ethylene, an α,β-unsaturated carboxylic acid having 3 to 8 carbon atoms, and an α,β-unsaturated carboxylic acid ester with a metal ion; and a mixture thereof. As the ionomer resin, one prepared by neutralizing an ethylene-(meth)acrylic acid binary copolymer with a metal ion, one prepared by neutralizing an ethylene-(meth)acrylic acid-(meth)acrylic acid ester ternary copolymer with a metal ion, and a mixture thereof, are particularly preferable.

The acid content in the ionomer resin is preferably 5 mass % or more, more preferably 6 mass % or more, even more preferably 7 mass % or more, and particularly preferably 8 mass % or more, and is preferably 30 mass % or less, more preferably 28 mass % or less, and even more preferably 26 mass % or less. By setting the acid amount to be 5 mass % or more and 30 mass % or less, desired hardness or rigidity is obtained while maintaining the fluidity of the cover composition. The term "acid content" as used herein refers to the content of an acidic group-containing component(s) in a resin. The term "acidic group-containing component" as used herein refers to a monomer component containing an acidic group such as a carboxyl group and the like, for example, a carboxyl group-containing monomer component such as an α,β-unsaturated carboxylic acid and the like.

Examples of a metal (ion) used to neutralize the ionomer resin include: monovalent metals (ions), such as sodium, potassium, lithium, and the like; divalent metals (ions), such as magnesium, calcium, zinc, barium, cadmium, and the like; trivalent metals (ions), such as aluminum and the like; and other metals (ions), such as tin, zirconium, and the like. These metals (ions) may be used solely or in combination of two or more thereof. Among these metals (ions), sodium, zinc and magnesium (ions) are particularly preferably used because they provide excellent resilience, durability, and the like.

The degree of neutralization of the acidic groups contained in the ionomer resin is preferably 5 mol % or more, more preferably 10 mol % or more, and even more preferably 15 mol % or more, and is preferably 100 mol % or less, more preferably 95 mol % or less, and even more preferably 90 mol % or less. The degree of neutralization of the acidic groups in the ionomer resin can be calculated using the following mathematical expression 2.

Degree of neutralization (mol %)=(the number of moles of acidic groups neutralized in an ionomer resin/the number of moles of all acidic groups contained in the ionomer resin)×100[Mathematical Expression 2]

The ionomer resin used in the present invention preferably contains two or more metals (ions) as neutralizing metals. The two or more metals (ions) are introduced into the ionomer resin in the following manners, for example: (I) acidic groups contained in one polymer are neutralized with two or more metals (ions); and (II) two or more polymers neutralized with respective different metals (ions) are mixed together, though the present invention is not particularly limited to these manners. The manner (II) is preferable.

When two or more neutralizing metals are introduced as described above, a combination of neutralizing metals is not particularly limited. For example, when two neutralizing metals are used in combination, the two neutralizing metals are preferably a monovalent metal (ion), such as sodium, potassium, lithium, and the like, and a divalent metal (ion), such as magnesium, calcium, zinc, barium, cadmium, and the like. Particularly, sodium and zinc are preferably used in combination. When sodium and zinc are used as neutralizing metals in combination, the resilience of the resultant ionomer resin can be improved, so that the resilience of a golf ball can be further improved.

The melt flow rate (190° C., 2.16 kg) of the ionomer resin is preferably 0.5 g/10 min or more, more preferably 1.5 g/10 min or more, and even more preferably 2.0 g/10 min or more, and is preferably 15 g/10 min or less, more preferably 14 g/10 min or less, and even more preferably 13 g/10 min or less. If the melt flow rate of the ionomer resin is 0.5 g/10 min or more, when the ionomer resin and the organically modified layered silicate are melt-mixed, the organically modified layered silicate is satisfactorily dispersed in the ionomer resin. In addition, during melt-mixing, an excessive shear force is not applied to the organically modified layered silicate, so that the organically modified layered silicate is not single-layered. If the melt flow rate is 15 g/10 min or less, when the ionomer resin and the organically modified layered silicate are melt-mixed, an appropriate level of shear force is obtained, so that the ionomer resin can be easily inserted into the interlayers of the organically modified layered silicate.

Note that the term "melt flow rate (190° C., 2.16 kg)" as used herein refers to the total amount of a resin that flows out per unit time through a hole having a diameter of 2.09 mm when a load of 2.16 kg is applied to the resin heated at 190° C. The melt flow rate is measured by a measuring method described below.

The slab hardness in Shore D Hardness of the ionomer resin is preferably 40 or more, more preferably 45 or more, and even more preferably 50 or more, and is preferably 75 or less, more preferably 73 or less, and even more preferably 70 or less. If the hardness in Shore D Hardness of the ionomer resin is 40 or more, the cover composition is not excessively soft and a desirable resilience is obtained. Further, if the hardness in Shore D Hardness of the ionomer resin is 75 or less, the cover composition is not excessively hard and sufficient durability is obtained.

Specific examples of the ionomer resins include, but not limited to, Himilan 1555(Na), Himilan 1557(Zn), Himilan 1605(Na), Himilan 1702(Zn), Himilan 1706(Zn), Himilan 1707(Na), Himilan AM7311 (Mg), Himilan AM7318(Na), Himila AM7329(Zn), Himilan 1856(Na) and Himilan 1855 (Zn) available from MITSUI-DUPONT POLYCHEMICAL CO., LTD.

Further, ionomer resins available from DUPONT CO. include Surlyn 8945(Na), Surlyn 9945(Zn), Surlyn 8140(Na), Surlyn 8150(Na), Surlyn 9120(Zn), Surlyn 9150 (Zn), Surlyn 6910(Mg), Surlyn 6120(Mg), Surlyn 7930(Li), Surlyn 7940(Li), Surlyn AD8546(Li), and examples of the ternary copolymer ionomer resin include Surlyn 6320(Mg), Surlyn 8120(Na), Surlyn 8320(Na), Surlyn 9320(Zn), and Surlyn 9320W(Zn), HPF 1000 (Mg), and HPF 2000(Mg).

Ionomer resins such as Iotek 8000(Na), Iotek 8030(Na), Iotek 7010(Zn), and Iotek 7030(Zn) are available from Exxon Co. Examples of the ternary copolymer ionomer resin include Iotek 7510(Zn) and Iotek 7520(Zn). The ionomer resins exemplified above can be used alone, or as a mixture of two or more.

Na, Zn, K, Li, or Mg described in the parentheses after the commercial name of the ionomer resin represents a kind of metal used for neutralization.

The cover composition forming the cover may contain, as a resin component, another resin component in addition to the ionomer resin as long as it does not impair the effects of the present invention. In one preferable embodiment of the present invention, the cover composition consists of the ionomer resin as the resin component.

Examples of the other resin component include a polyurethane resin, a thermoplastic elastomer and the like. Specific examples of the polyurethane resin include "Elastollan (registered trademark)" commercially available from BASF Japan Ltd. and the like. Specific examples of the thermoplastic elastomer include: a thermoplastic polyamide elastomer having a commercial name of "Pebax (registered trademark) (e.g. "Pebax 2533")" commercially available from Arkema K. K.; a thermoplastic polyester elastomer having a commercial name of "Hytrel (registered trademark) (e.g. "Hytrel 3548", "Hytrel 4047")" commercially available from Du Pont-Toray Co., Ltd., or a commercial name of "Primalloy (registered trademark) (e.g. "Primalloy A1500")" commercially available from Mitsubishi Chemical Corporation; a thermoplastic polystyrene elastomer having a commercial name of "Rabalon (registered trademark)" commercially available from Mitsubishi Chemical Corporation; and the like.

The amount of the organically modified layered silicate in the cover, with respect to 100 parts by mass of the ionomer resin, is preferably 0.01 parts by mass or more, more preferably 0.05 parts by mass or more, and even more preferably 0.1 parts by mass or more, and is preferably 10 parts by mass or less, more preferably 8 parts by mass or less, and even more preferably 6 parts by mass or less. If the amount of the organically modified layered silicate in the cover is 0.01 parts by mass or more with respect to 100 parts by mass of the ionomer resin, a higher improvement effect in durability and a higher improvement effect in resilience are obtained. If the amount of the organically modified layered silicate in the cover is 10 parts by mass or less, the cover is not excessively hard and more desirable durability is obtained.

The cover composition may contain, in addition to the aforementioned resin component and the like, a pigment component such as titanium oxide, a blue pigment, and the like, a specific gravity adjusting agent such as calcium carbonate, barium sulfate, and the like, a dispersant, an antioxidant, an ultraviolet absorber, a light stabilizer, a fluorescent material, a fluorescent brightener, and the like, as long as they do not impair the performance of the cover.

The amount of the white pigment (titanium oxide), with respect to 100 parts by mass of the ionomer resin contained in the cover, is preferably 0.5 parts by mass or more, more preferably 1 parts by mass or more, and is preferably 10 parts by mass or less, more preferably 8 parts by mass or less. By causing the amount of the white pigment to be 0.5 parts by mass or more, it is possible to provide opacity to the cover. If the amount of the white pigment is more than 10 parts by mass, there is the possibility that the durability of the resultant cover will deteriorate.

The slab hardness in Shore D Hardness of the cover is preferably 40 or more, more preferably 45 or more, and even more preferably 50 or more, and is preferably 80 or less, more preferably 75 or less, and even more preferably 70 or less. If the hardness in Shore D Hardness of the cover is 40 or more, the cover is not excessively soft and sufficient resilience is obtained. On the other hand, if the slab hardness in Shore D Hardness of the cover is 80 or less, the cover is not excessively hard and sufficient durability is obtained. Here, the slab hardness of the cover is a measured hardness of a sheet that is molded in a sheet form by using the cover composition under injection conditions similar to conditions for molding of the cover. The slab hardness is measured using a measuring method described below.

Described next is a manufacturing method for obtaining the golf ball of the present invention.

A golf ball manufacturing method of the present invention includes: an organic modification step of organically modifying a layered silicate by using an organic cation to manufacture an organically modified layered silicate; and a cover molding step of forming a cover such that the organically modified layered silicate in the cover has an interlayer distance measured by X-ray diffraction in a range from 2.5 nm to 15 nm, by using the organically modified layered silicate, an ionomer resin, and an additive as ingredients of the cover. Furthermore, the golf ball manufacturing method of the present invention preferably has a nanocomposite step of mixing the organically modified layered silicate and the ionomer resin before the cover molding step to prepare a nanocomposite having an interlayer distance of a layered silicate in a range from 2.0 nm to 15 nm.

When using an organically modified layered silicate that is organically modified beforehand (e.g. "Dellite (registered trademark) 43B" commercially available from Laviosa Chimica Mineraria S.p.A.), the step for manufacturing an organically modified layered silicate by organically modifying a layered silicate with an organic cation can be skipped.

In the organic modification step, the method for manufacturing an organically modified layered silicate by organically modifying a layered silicate with an organic cation, may be conducted by a cation-exchange reaction caused by contact of the layered silicate and the organic cation. The cation-exchange reaction may be conducted, for example, by dispersing an organic layered silicate in a dispersion medium, adding in an organic cation to this dispersion medium, and stirring the mixture.

Examples of the dispersion medium for dispersing the layered silicate include water, N-methylformamide, and formamide. The layered silicate in the dispersion medium may be dispersed by mechanical stirring, and stirring time is preferably one hour or longer, and more preferably two hours or longer. In order to promote dispersion of the layered silicate, air blowing or application of ultrasound may be used together with mechanical stirring.

The temperature of the dispersion liquid used during the cation-exchange reaction is preferably 50° C. or higher, and more preferably 60° C. or higher, and even more preferably 70° C. or higher, and preferably 100° C. or lower, and more preferably 95° C. or lower, and even more preferably 90° C. or lower. Furthermore, the reaction time for the cation-exchange reaction is preferably 1 hour or longer, and more preferably 2 hours or longer, and even more preferably 3 hours or longer, and preferably 20 hours or shorter, and more preferably 18 hours or shorter, and even more preferably 15 hours or shorter.

After the reaction, an organically modified layered silicate is obtained by; filtering out the organically modified layered silicate from a reaction liquid by means of vacuum filtration, rinsing the organically modified layered silicate with water or a methanol aqueous solution thoroughly, and drying the rinsed organically modified layered silicate.

The method for manufacturing a nanocomposite in the nanocomposite process by mixing an organically modified layered silicate and the ionomer resin is not particularly limited, however, a method that uses a twin-screw extruder for the mixing is preferred.

With regard to mixing conditions when mixing the organically modified layered silicate and the ionomer resin by the twin-screw extruder, the mixing temperature is preferably 140° C. or higher, and more preferably 150° C. or higher, and preferably 220° C. or lower, and more preferably 210° C. Furthermore, a mixing temperature from an input opening to a die may be set constant, however, a temperature gradient in a range of 140° C. to 220° C. may also be used. Furthermore, for example, when using a full flight screw (screw diameter: 2 cm), the screw L/D is preferably 25 or more, and more preferably 30 or more. The screw rotational speed is preferably 50 rpm or more, and more preferably 60 rpm or more, and preferably 200 rpm or less, and more preferably 190 rpm or less, and even more preferably 120 rpm or less.

The interlayer distance of the organically modified layered silicate in the nanocomposite is preferably 2.0 nm or more, more preferably 2.2 nm or more, and even more preferably 2.5 nm or more, and is preferably 15 nm or less, more preferably 14.5 nm or less, and even more preferably 14.0 nm or less. If the interlayer distance of the organically modified layered silicate in the nanocomposite is less than 2.0 nm, the ionomer resin is not sufficiently inserted into the interlayers of the organically modified layered silicate, so that the durability is not likely to be improved. If the interlayer distance exceeds 15 nm, the organically modified layered silicate transforms into an almost separated state and an interaction between the organically modified layered silicate and the ionomer resin decreases. Thus, the durability is not likely to be improved.

The method for mixing the nanocomposite and the additive and injection-molding the cover in the cover molding process is not particularly limited, however, a method that uses a twin screw extruder is preferable.

With regard to mixing conditions when mixing the nanocomposite and the additive by using the twin-screw extruder, the mixing temperature is preferably 140° C. or higher, and more preferably 150° C. or higher, and preferably 220° C. or lower, and more preferably 210° C. or lower. The mixing temperature may be set constant, or gradually changed within the range of 140° C. to 220° C., from the input opening to the die. For example, when a full flight screw (screw diameter: 2 cm) is used, the screw L/D is preferably 25 or more, more preferably 30 or more. The screw rotational speed is preferably 50 rpm or more, more preferably 60 rpm or more, and is preferably 200 rpm or less, more preferably 190 rpm or less, and even more preferably 120 rpm or less.

When a method that direct-injection-molds the cover composition on the core is used, it is preferred if the upper and lower molds adopted for forming the cover have a hemispherical cavity and pimples, and some of the pimples are extendable and retractable to act also as hold pins. When forming the cover by injection-molding, the cover may be molded by extending out the hold pins to hold the inputted core, injecting the cover composition, and cooling the cover composition. For example; a cover composition heated to a temperature of 140 to 220° C. is injected, within a time duration of 0.5 to 5 seconds, into a closed mold that is held with a pressure of 9 MPa to 15 MPa, and the mold is opened after 10 to 60 seconds of cooling.

The cover thickness of the golf ball of the present invention is preferably 0.3 mm or more, and more preferably 0.5 mm or more, and preferably 2.0 mm or less, and more preferably 1.8 mm or less, and even more preferably 1.6 mm or less. By having the cover thickness of 0.3 mm or more, the positive effect of the present invention can be obtained and the durability improves, and on the other hand, by having the cover thickness of 2.0 mm or less, sufficient resilience is obtained.

When molding a cover, the concave portions called "dimple" are usually formed on the surface. After the cover is molded, the mold is opened and the golf ball body is taken out from the mold, and as necessary, the golf ball body is preferably subjected to surface treatment such as deburring, cleaning, and sandblast. If desired, a paint film or a mark may be formed. The paint film preferably has a thickness of, but not limited to, 5 μm or larger, and more preferably 7 μm or larger, and preferably has a thickness of 25 μm or smaller, and more preferably 18 μm or smaller. This is because if the thickness is smaller than 5 μm, the paint film is easy to wear off due to continued use of the golf ball, and if the thickness is larger than 25 μm, the effect of the dimples is reduced, resulting in deteriorating flying performance of the golf ball.

Next, the preferable embodiment of the core of the golf ball of the present invention will be explained.

The core of the golf ball of the present invention includes a single layered core, a core consisting of a center and a single-layered intermediate layer covering the center, a core consisting of a center and multi-piece or multi-layer of intermediate layers covering the center. The core preferably has a spherical shape. If the core does not have a spherical shape, the cover does not have a uniform thickness. As a result, there exist some portions where the performance of the cover is lowered. On the other hand, the center generally has the spherical shape, but the center may be provided with a rib on the surface thereof so that the surface of the spherical center is divided by the ribs. For example, the surface of the spherical center is evenly divided by the ribs. In one embodiment, the ribs are preferably formed on the surface of the spherical center in an integrated manner, and in another embodiment, the ribs are formed as an intermediate layer on the surface of the spherical center.

The ribs are preferably formed along an equatorial line and meridians that evenly divide the surface of the spherical center, if the spherical center is assumed as the earth. For example, if the surface of the spherical center is evenly divided into 8, the ribs are formed along the equatorial line, any meridian as a standard, and meridians at the longitude 90 degrees east, longitude 90 degrees west, and the longitude 180 degrees east (west), assuming that the meridian as the standard is at longitude 0 degree. If the ribs are formed, the depressed portion divided by the ribs are preferably filled with a plurality of intermediate layers or with a single-layered intermediate layer that fills each of the depressed portions to make a core in the spherical shape. The shape of the ribs, without limitation, includes an arc or an almost arc (for example, a part of the arc is removed to obtain a flat surface at the cross or orthogonal portions thereof).

As the core or the center of the golf ball of the present invention, a conventionally known rubber composition (hereinafter simply referred to as "core rubber composition" occasionally) may be employed, and it can be molded by, for example, heat-pressing a rubber composition containing a base rubber, a crosslinking initiator, a co-crosslinking agent, and a filler.

As the base rubber, a natural rubber and/or a synthetic rubber such as a polybutadiene rubber, a natural rubber, a polyisoprene rubber, a styrene polybutadiene rubber, and ethylene-propylene-diene terpolymer (EPDM) may be used. Among them, typically preferred is the high cis-polybutadiene having cis-1,4 bond in a proportion of 40% or more, more preferably 70% or more, even more preferably 90% or more in view of its superior repulsion property.

The crosslinking initiator is blended to crosslink the base rubber component. As the crosslinking initiator, an organic peroxide is preferably used. Examples of the organic peroxide for use in the present invention are dicumyl peroxide, 1,1-bis(t-butylperoxy)-3,5-trimethylcyclohexane, 2,5-dimethyl-2,5-di(t-butylperoxy)hexane, and di-t-butyl peroxide. Among them, dicumyl peroxide is preferable. An amount of the crosslinking initiator to be blended in the rubber composition is preferably 0.2 part by mass or more, more preferably 0.3 part by mass or more, and is preferably 3 parts by mass or less, more preferably 2 parts by mass or less based on 100 parts by mass of the base rubber. If the amount is less than 0.2 part by mass, the core becomes too soft, and the resilience tends to be lowered, and if the amount is more than 3 parts by mass, the core becomes too hard, and the shot feeling may be lowered.

The co-crosslinking agent is not particularly limited as long as it has the effect of crosslinking a rubber molecule by graft polymerization with a base rubber molecular chain; for example, α,β-unsaturated carboxylic acid having 3 to 8 carbon atoms or a metal salt thereof, more preferably acrylic acid, methacrylic acid or a metal salt thereof may be used. As the metal constituting the metal salt, for example, zinc, magnesium, calcium, aluminum and sodium may be used, and among them, zinc is preferred because it provides high resilience. The amount of the co-crosslinking agent to be used is preferably 10 parts or more, more preferably 20 parts or more, and is preferably 50 parts or less, more preferably 40 parts or less based on 100 parts of the base rubber by mass. If the amount of the co-crosslinking agent to be used is less than 10 parts by mass, the amount of the crosslinking initiator must be increased to obtain an appropriate hardness, which tends to lower the resilience. On the other hand, if the amount of the co-crosslinking agent to be used is more than 50 parts by mass, the core becomes too hard, so that the shot feeling may be lowered.

The filler contained in the core rubber composition is mainly blended as a specific gravity adjusting agent in order to adjust the specific gravity of the golf ball obtained as the final product in the range of 1.0 to 1.5, and may be blended as required. Examples of the filler include an inorganic filler such as zinc oxide, barium sulfate, calcium carbonate, magnesium oxide, tungsten powder, and molybdenum powder. The amount of the filler to be blended in the rubber composition is preferably 2 parts or more, more preferably 3 parts or more, and preferably 50 parts or less, more preferably 35 parts or less based on 100 parts of the base rubber by mass. If the amount of the filler to be blended is less than 2 parts by mass, it becomes difficult to adjust the weight, while if it is more than 50 parts by mass, the weight ratio of the rubber component becomes small and the resilience tends to be lowered.

As the core rubber composition, an organic sulfur compound, an antioxidant or a peptizing agent may be blended appropriately in addition to the base rubber, the crosslinking initiator, the co-crosslinking agent and the filler.

As the organic sulfur compound, a diphenyl disulfide or a derivative thereof may be preferably used. Examples of the diphenyl disulfide or the derivative thereof include diphenyl disulfide, a mono-substituted diphenyl disulfide such as bis(4-chlorophenyl)disulfide, bis(3-chlorophenyl)disulfide, bis(4-bromophenyl) disulfide, bis(3-bromophenyl)disulfide, bis(4-fluorophenyl)disulfide, bis(4-iodophenyl)disulfide and bis(4-cyanophenyl)disulfide; a di-substituted diphenyl disulfide such as bis(2,5-dichlorophenyl)disulfide, bis(3,5-dichlorophenyl)disulfide, bis(2,6-dichlorophenyl)disulfide, bis(2,5-dibromophenyl)disulfide, bis(3,5-dibromophenyl)disulfide, bis(2-chloro-5-bromophenyl)disulfide, and bis(2-cyano-5-bromophenyl)disulfide; a tri-substituted diphenyl disulfide such as bis(2,4,6-trichlorophenyl)disulfide, and bis(2-cyano-4-chloro-6-bromophenyl)disulfide; a tetra-substituted diphenyl disulfide such as bis(2,3,5,6-tetra chlorophenyl)disulfide; a penta-substituted diphenyl disulfide such as bis(2,3,4,5,6-pentachlorophenyl)disulfide and bis(2,3,4,5,6-pentabromophenyl)disulfide. These diphenyl disulfides or the derivative thereof can enhance resilience by having some influence on the state of vulcanization of vulcanized rubber. Among them, diphenyl disulfide and bis(pentabromophenyl) disulfide are preferably used since a golf ball having particularly high resilience can be obtained. The amount of the diphenyl disulfide or the derivative thereof to be blended is preferably 0.1 part by mass or more, more preferably 0.3 part by mass or more, and preferably 5.0 parts by mass or less, more preferably 3.0 parts by mass or less relative to 100 parts by mass of the base rubber.

The amount of the antioxidant to be blended is preferably 0.1 part or more and is preferably 1 part or less based on 100 parts of the base rubber by mass. Further, the amount of the peptizing agent is preferably 0.1 part or more and is preferably 5 parts or less based on 100 parts of the base rubber by mass.

The conditions for press-molding the core rubber composition should be determined depending on the rubber composition. The press-molding is preferably carried out for 10 to 60 minutes at the temperature of 130° C. to 200° C. Alternatively, the press-molding is preferably carried out in a two-step heating, for example, for 20 to 40 minutes at the temperature of 130° C. to 150° C., and continuously for 5 to 15 minutes at the temperature of 160° C. to 180° C.

The core preferably has a diameter of 39.0 mm or larger, more preferably 39.5 mm or larger, even more preferably 40.8 mm or large. If the diameter of the core is smaller than 39.0 mm, the thickness of the cover needs to be thicker than a desired thickness, resulting in the reduction of the golf ball's resilience. The upper limit of the diameter of the core is preferably, without limitation, 42.2 mm, more preferably 42.0 mm, even more preferably 41.8 mm. If the diameter of the core is larger than 42.2 mm, the thickness of the cover needs to be relatively thinner, and the protection effect of the cover may not be obtained.

A compression deformation amount (shrinking deformation amount of the core along the compression direction) of the core when applying a load from 98 N as an initial load to 1275 N as a final load is preferably 2.50 mm or more, more preferably 2.60 mm or more, even more preferably 2.70 mm or more, and is preferably 3.20 mm or less, more preferably 3.10 mm or less, even more preferably 3.00 mm or less. If the compression deformation amount is too small, the core becomes too hard, resulting in the poor shot feeling, while if the compression deformation amount is too large, the core becomes too soft, resulting in the heavy shot feeling.

It is preferable that the core of the present invention has a larger surface hardness than the center hardness. For example, if the core consists of multiple layers, it is easy to make the surface hardness larger than the center hardness. The hardness difference between the surface and the center of the core in the golf ball of the present invention is preferably 20 or larger, more preferably 25 or larger in Shore D hardness. Making the surface hardness of the core larger than the center hardness increases the launch angle and decreases the amount of spin, thereby improving the flight distance of the golf ball. The upper limit of the hardness difference between the surface and the center of the core is, without limitation, preferably 40, more preferably 35 in Shore D. If the hardness difference is too large, the durability of the golf ball tends to be lower.

The center hardness of the core is preferably 30 or larger, more preferably 32 or larger, and even more preferably 35 or larger in Shore D hardness. If the center hardness is smaller than 30 in Shore D hardness, the core becomes so soft that the resilience of the golf ball tends to be lower. The center hardness of the core is preferably 50 or smaller, more preferably 48 or smaller, and even more preferably 45 or smaller in Shore D. If the center hardness is larger than 50 in Shore D hardness, the core becomes so hard that the shot feeling deteriorates. In the present invention, the center hardness of the core is the hardness measured with the Shore D type spring hardness tester at the central point of a cut plane of a core which has been cut into two halves.

The surface hardness of the core is preferably 45 or larger, more preferably 50 or larger, and even more preferably 55 or larger in Shore D hardness. If the surface hardness is smaller than 45, the core becomes so soft and the resilience may be lowered. The surface hardness of the core is preferably 65 or smaller, more preferably 62 or smaller, and even more preferably 60 or smaller in shore D hardness. If the surface hardness is larger than 65 in Shore D hardness, the core becomes so hard that the shot feeling may deteriorate.

The core in the golf ball of the present invention preferably has a PGA compression of 65 or more, more preferably 70 or more. The resilience reduces if the PGA compression of the core is below 65. This also makes the shot feeling too heavy because the core is too soft. The upper limit of the PGA compression of the core is not particularly limited, but is preferably 115, more preferably 110. If the PGA compression of the core exceeds 115, the core becomes too hard and the shot feeling deteriorates.

Examples of the material that constitute the intermediate layer are: thermoplastic resins such as a polyurethane resin, an ionomer resin, nylon and polyethylene; and thermoplastic elastomers such as a polystyrene elastomer, a polyolefin elastomer, a polyurethane elastomer and a polyester elastomer. Among these, the ionomer resin is preferred.

Examples of the ionomer resin include an ionomer resin prepared by neutralizing at least a part of carboxyl groups in a copolymer composed of ethylene and α,β-unsaturated carboxylic acid having 3 to 8 carbon atoms with a metal ion, one prepared by neutralizing at least a part of carboxyl groups in a ternary copolymer composed of ethylene, α,β-unsaturated carboxylic acid having 3 to 8 carbon atoms and α,β-unsaturated carboxylic acid ester with a metal ion, or a mixture thereof.

Examples of the α,β-unsaturated carboxylic acids are; acrylic acid, methacrylic acid, fumaric acid, maleic acid and crotonic acid. Among these, acrylic acid and methacrylic acid are particularly preferred. Examples of the α,β-unsaturated carboxylic acid ester include methyl ester, ethyl ester, propyl ester, n-butyl ester, isobutyl ester of acrylic acid, methacrylic acid, fumaric acid, and maleic acid. In particular, acrylic acid ester and methacrylic acid ester are preferable. Examples of the metal ion for neutralizing at least a part of the carboxyl groups in the copolymer composed of ethylene and the α,β-unsaturated carboxylic acid or in the terpolymer composed of ethylene, the α,β-unsaturated carboxylic acid, and the α,β-unsaturated carboxylic acid ester are; monovalent metal ions such as sodium, potassium, and lithium; divalent metal ions such as magnesium, calcium, zinc, barium, and cadmium; trivalent metal ions such as aluminum, or other metal ions such as tin and zirconium. In particular, sodium ion, zinc ion, and magnesium ion are preferably used in view of the resilience and durability of the golf ball.

The intermediate layer of the golf ball of the present invention may contain a specific gravity adjusting agent such as barium sulfate and tungsten, an anti-oxidant, and a pigment in addition to the above resin component.

The golf ball of the present invention is not particularly limited on a structure thereof as long as the golf ball has a core and a cover. Examples of the golf ball of the present invention include a two-piece golf ball comprising a single-layered core, and a cover covering the core; a three-piece golf ball comprising a core consisting of a center and an intermediate layer covering the center, and a cover covering the core; a multi-piece golf ball comprising a core consisting of a center and a multi-piece or multi-layer of intermediate layers covering the center, and a cover covering the core; and a wound golf ball comprising a wound core, and a cover covering the wound core. The present invention can be suitably applied to anyone of the above golf ball. Among them, the present invention can be preferably applied to the two-piece golf ball including a single-layered core, and a cover covering the core.

When preparing a wound golf ball in the present invention, a wound core may be used as the core. In that case, for example, a wound core comprising a center formed by curing the above rubber composition for the core and a rubber thread layer which is formed by winding a rubber thread around the center in an elongated state can be used. In the present invention, the rubber thread, which is conventionally used for winding around the center, can be adopted for winding around the center. The rubber thread, for example, is obtained by vulcanizing a rubber composition including a natural rubber, or a mixture of a natural rubber and a synthetic polyisoprene, a sulfur, a vulcanization auxiliary agent, a vulcanization accelerator, and an antioxidant. The rubber thread is wound around the center in elongation of about 10 times length to form the wound core.

EXAMPLES

Hereinafter, the present invention will be described in detail by way of example. The present invention is not limited to examples described below. Various changes and modifications can be made without departing from the spirit and scope of the present invention.

[Evaluation Method]

(1) X-ray Diffraction Measurement

X-ray diffraction measurements were conducted with an X-ray diffractometer (RINT2200 V-TYPE, manufactured by Rigaku Corporation) by using the following measuring conditions to measure the interlayer distance of the organically modified layered silicate, and the layered silicate contained within the nanocomposite or the cover. The interlayer distance of the layered silicate contained within the cover was measured by X-ray diffraction measurement of an organically modified layered silicate contained in a sheet. This sheet is molded in a sheet form, by using the nanocomposite and titanium dioxide in a similar manner to a composition used for molding the cover of each golf ball, and under injection conditions similar to conditions for molding of the cover.

Measuring Conditions

X-ray source: CuKα radiation (wavelength λ=0.15418 nm)

Applied voltage: 40 kV

Applied current: 30 mA

Measured range: 2θ=0.01° to 100°

Measured interval: 0.01°

Calculation formula: 2d sin θ=μ=0.15418 nm (θ: ½ of the peak angle (2θ))

(2) Melt Flow Rate (MFR) (190° C., 2.16 kg)

The MFR was measured using a flowmeter (Shimadzu flowmeter CFT-100C manufactured by Shimadzu Corporation) in accordance with JIS K7210. The measurement was conducted at a measurement temperature of 190° C. using a load of 2.16 kg.

(3) Core Hardness (Shore D Hardness)

A type P1 auto loading durometer manufactured by Kobunshi Keiki Co., Ltd., which comprises a Shore D type spring hardness tester which complies to ASTM-D2240 standard was used to measure the surface hardness and the center hardness of a spherical core. A Shore D hardness measured at the surface of the spherical core was defined as the surface hardness of the spherical core. The spherical core was cut into two hemispheres to obtain a cut plane, and a Shore D hardness measured at the center of the cut plane was defined as the center hardness of the spherical core.

(4) Compression Deformation Amount (mm)

An amount of compression deformation of the golf ball (an amount of compression of the golf ball in the compression direction thereof, when applying an initial load of 98 N to a final load of 1275 N to the core, was measured.

(5) Slab Hardness (Shore D Hardness)

Sheets with a thickness of approximately 2 mm were manufactured with the cover composition by hot press molding, and stored for 2 weeks at 23° C. Three or more of these sheets were stacked on one another so as not to be affected by the measuring base on which the sheets were placed, and the stack was measured with a type P1 auto loading durometer manufactured by Kobunshi Keiki Co., Ltd., which comprises a Shore D type spring hardness tester which complies to ASTM-D2240 standard.

(6) Coefficient of Repulsion

A 200 g aluminum cylindrical object was forced to collide with each golf ball at a speed of 40 m/sec, and the speeds of the cylindrical object and the golf ball before and after the collision were measured. Based on these speeds and the mass of each object, coefficient of repulsion for each golf ball was calculated. The measurement was conducted by using twelve of each golf ball, and the average value was regarded as the coefficient of repulsion for the golf ball. The coefficient of repulsion of golf ball No. 1 was defined as an index of 100, and the coefficient of repulsion of each golf ball was represented by converting the coefficient of repulsion of each golf ball into this index.

(7) Durability

A metal-headed #W1 driver was installed on a swing robot M/C manufactured by Golf Laboratories, Inc. Each golf ball was hit at a head speed of 45 m/sec. This procedure was repeated, and the number of hits required to break the golf ball was counted. This number of hits was categorized into 4 levels to evaluate the durability of each golf ball.

Evaluation Criteria

E (Excellent): The number of hits until breakage occurs is 200 or more

G (Good): The number of hits until breakage occurs is 150 or more and less than 200.

F (Fair): The number of hits until breakage occurs is 100 or more and less than 150.

P (Poor): The number of hits until breakage occurs is less than 100.

Production of Organically Modified Layered Silicate

Production Example 1

One liter of distilled water was heated to 80° C., and 20 g of montmorillonite ("Kunipia (registered trademark) F" from Kunimine Industries Co., Ltd. with a cation exchange capacity of 115 meq/100 g and an interlayer distance of 1 nm) was added to the water and sufficiently dispersed by stirring for three hours or longer. 7.44 g of stearylamine (manufactured by Tokyo Chemical Industry Co., Ltd.) and 2.5 ml of a 12 mol/l hydrochloric acid solution was mixed in advance, and organic modification was conducted by adding the total amount of this stearylamine hydrochloride solution mixture to the montmorillonite dispersion liquid, and by stirring the obtained reaction liquid for 1 hour while heating at 80° C.

The reaction liquid after organic modification was vacuum filtered, and the obtained filtered substance was first rinsed with water, and then thoroughly rinsed with a methanol aqueous solution (water:methanol=1:1 (ratio by mass)). The obtained rinsed substance was dried for 24 hours at 60° C., resulting in 26.1 g of stearyl ammonium exchanged montmorillonite (hereinafter, may be referred to as "C18").

When measurement of X-ray diffraction was conducted for the C18, the interlayer distance of the montmorillonite was 2 nm. Further, the montmorillonite amount contained within the C18 was 77 mass %, and the ion exchange rate was 100 mol %.

[Production of Nanocomposite]

A nanocomposite in the form of a pellet was prepared by mixing the C18, and an ionomer resin in a formulation shown in Table 1 by using a twin-screw extruder ("2D25S", manufactured by Toyo Seiki Seisaku-sho, Ltd.). Further, a full flight screw (screw diameter 2 cm, screw L/D=25) with a screw rotational speed of 70 rpm was used as specifications of the twin-screw extruder. With regard to the mixing temperature; a temperature gradient was created at the intermixed region from the input opening to the die with temperatures of 160° C., 170° C., and 180° C., sequentially from the input opening, with the temperature of the die being at 180° C.

The interlayer distance of the montmorillonite in each of the obtained nanocomposites was measured, and the results are shown in Table 1.

TABLE 1-1

| | | | Nanocomposite No. | | | | | | |
|---|---|---|---|---|---|---|---|---|---|
| | | | 1 | 2 | 3 | 4 | 5 | 6 | 7 |
| Formulation | Resin component | HIMILAN 1605 (Na) | 50 | 50 | 50 | 50 | 50 | 50 | 50 |
| | | HIMILAN 1557 (Zn) | 50 | 50 | 50 | 50 | 50 | 50 | 50 |
| | | HIMILAN 1707 (Na) | — | — | — | — | — | — | — |
| | | HIMILAN 1706 (Zn) | — | — | — | — | — | — | — |
| | | HIMILAN AM7318 (Na) | — | — | — | — | — | — | — |
| | | HIMILAN 1555 (Na) | — | — | — | — | — | — | — |
| | | HIMILAN 1702 (Zn) | — | — | — | — | — | — | — |
| | | NUCREL 1560 | — | — | — | — | — | — | — |
| | Organically modified layered silicate | C18 | 0.01 | 0.1 | 0.5 | 2.0 | 5.0 | 10.0 | 15.0 |
| | Layered silicate | Mon | — | — | — | — | — | — | — |
| | Mixing condition | Temperature of die [° C.] | 180 | 180 | 180 | 180 | 180 | 180 | 180 |
| Properties | MFR of resin component (190° C., 2.16 kg) [g/10 min] | | 4.1 | 4.1 | 4.1 | 4.1 | 4.1 | 4.1 | 4.1 |
| | Interlayer distance of layered silicate [nm] | | 2.71 | 2.83 | 2.96 | 3.12 | 3.55 | 3.83 | 3.92 |

Formulation: parts by mass

TABLE 1-2

| | | | Nanocomposite No. | | | | | |
|---|---|---|---|---|---|---|---|---|
| | | | 8 | 9 | 10 | 11 | 12 | 13 |
| Formulation | Resin component | HIMILAN 1605 (Na) | — | — | 50 | 50 | — | — |
| | | HIMILAN 1557 (Zn) | — | — | 50 | 50 | — | — |
| | | HIMILAN 1707 (Na) | — | — | — | — | 50 | — |
| | | HIMILAN 1706 (Zn) | 50 | — | — | — | 50 | — |
| | | HIMILAN AM7318 (Na) | 50 | — | — | — | — | — |
| | | HIMILAN 1555 (Na) | — | 50 | — | — | — | 45 |
| | | HIMILAN 1702 (Zn) | — | 50 | — | — | — | 45 |
| | | NUCREL 1560 | — | — | — | — | — | 10 |
| | Organically modified layered silicate | C18 | 2.0 | 2.0 | — | — | 2.0 | 2.0 |
| | Layered silicate | Mon | — | — | — | 2.0 | — | — |
| | Mixing condition | Temperature of die [° C.] | 180 | 180 | 180 | 180 | 180 | 180 |
| Properties | MFR of resin component (190° C., 2.16 kg) [g/10 min] | | 1.2 | 13 | 4.1 | 4.1 | 0.9 | 20 |
| | Interlayer distance of layered silicate [nm] | | 14.9 | 2.61 | — | 1.02 | >15 | 2.11 |

Formulation: parts by mass

HIMILAN 1605: a sodium ion neutralized ethylene-methacrylic acid copolymer ionomer resin (MFR: 2.8 g/10 min, Shore D hardness: 65) manufactured by Du Pont-Mitsui Polychemicals Co., Ltd.

HIMILAN 1557: a zinc ion neutralized ethylene-methacrylic acid copolymer ionomer resin (MFR: 5.5 g/10 min, Shore D hardness: 59) manufactured by Du Pont-Mitsui Polychemicals Co., Ltd.

HIMILAN 1707: a sodium ion neutralized ethylene-methacrylic acid copolymer ionomer resin (MFR: 0.9 g/10 min, Shore D hardness: 65) manufactured by Du Pont-Mitsui Polychemicals Co., Ltd.

HIMILAN 1706: a zinc ion neutralized ethylene-methacrylic acid copolymer ionomer resin (MFR: 0.9 g/10 min, Shore D hardness: 64) manufactured by Du Pont-Mitsui Polychemicals Co., Ltd.

HIMILAN AM7318: a sodium ion neutralized ethylene-methacrylic acid copolymer ionomer resin (MFR: 2.2 g/10 min, Shore D hardness: 65) manufactured by Du Pont-Mitsui Polychemicals Co., Ltd.

HIMILAN 1555: a sodium ion neutralized ethylene-methacrylic acid copolymer ionomer resin (MFR: 10 g/10 min, Shore D hardness: 60) manufactured by Du Pont-Mitsui Polychemicals Co., Ltd.

HIMILAN 1702: a zinc ion neutralized ethylene-methacrylic acid copolymer ionomer resin (MFR: 16 g/10 min, Shore D hardness: 59) manufactured by Du Pont-Mitsui Polychemicals Co., Ltd.

NUCREL 1560: an ethylene-methacrylic acid copolymer (MFR: 60 g/10 min, Shore D hardness: 53) manufactured by Du Pont-Mitsui Polychemicals Co., Ltd. Organically modified layered silicate C18: stearyl ammonium exchanged montmorillonite (montmorillonite content: 73 mass %, the interlayer distance of the layered silicate: 2.01 nm)

Layered silicate Mon: montmorillonite "Kunipia (registered trademark) F" manufactured by Kunimine Industries Co., Ltd.

[Production of Golf Ball]

(1) Production of Core

A spherical core with a diameter of 40.7 mm was obtained, by kneading a core rubber composition having the formulation shown in Table 2, and heat-pressing the kneaded object in upper and lower molds, each having a hemispherical cavity, at a temperature of 160° C. for 13 minutes.

TABLE 2

| | Core | |
|---|---|---|
| Formulation | Polybutadiene | 100 |
| | Zinc acrylate | 33 |
| | Zinc oxide | 12.0 |
| | Barium sulfate | 14.0 |
| | Diphenyl disulfide | 0.5 |
| | Dicumyl peroxide | 0.9 |

TABLE 2-continued

| Core | | |
|---|---|---|
| Properties | Center hardness (Shore D hardness) | 40 |
| | Surface hardness (Shore D hardness) | 58 |
| | Compression deformation amount (mm) | 2.90 |

Formulation: parts by mass

Polybutadiene rubber: "BR18 (high-cis polybutadiene (cis content: 96% or more))" manufactured by JSR Corporation Zinc acrylate: "ZNDA-90S" manufactured by Nihon Jyoryu Kogyo Co., Ltd.

Zinc oxide: "Ginrei R" manufactured by Toho Zinc Co., Ltd.

Barium sulfate: "Barium Sulfate BD" manufactured by Sakai Chemical Industry Co., Ltd.

Diphenyl disulfide: manufactured by Sumitomo Seika Chemicals Co., Ltd.

Dicumyl peroxide: "Percumyl (registered trademark) D" manufactured by NOF Corporation (2) Preparation of Cover Composition and Production of Golf Ball Body Next, a cover that covers the core was produced by mixing the nanocomposite obtained above and titanium dioxide with a twin-screw extruder ("2D25S", manufactured by Toyo Seiki Seisaku-sho, Ltd.), and injection-molding the mixture directly onto the core. Further, a full flight screw (screw diameter: 2 cm, screw L/D=25) with a screw rotational speed of 70 rpm was used as specifications of the twin-screw extruder. With regard to the mixing temperature; a temperature gradient was created at the intermixed region from the input opening to the die with temperatures of 160° C., 170° C., and 180° C., sequentially from the input opening; and the temperature of the die was set as shown in Table 3. The added amount of titanium dioxide was adjusted so as to be 4 parts by mass with respect to 100 parts by mass of the resin component of the nanocomposite.

The surface of the obtained golf ball body was treated with sandblast, marked, and painted with a clear paint. The paint was dried in an oven at 40° C., and a golf ball with a diameter of 42.7 mm was obtained.

The evaluation results of the obtained golf balls regarding durability and resilience are shown in Table 3.

TABLE 3-1

| | | | | | Golf ball No. | | | | |
|---|---|---|---|---|---|---|---|---|---|
| | | | | | 1 | 2 | 3 | 4 | 5 |
| Cover | Formulation | Nanocomposite | | No. | 1 | 2 | 3 | 4 | 5 |
| | | | Layered silicate | Type | C18 | C18 | C18 | C18 | C18 |
| | | | | Amount relative to 100 parts by mass of resin component [parts by mass] | 0.01 | 0.1 | 0.5 | 2.0 | 5.0 |
| | | Titanium dioxide | | Amount relative to 100 parts by mass of resin component in nanocomposte [parts by mass] | 4 | 4 | 4 | 4 | 4 |
| | Properties | | | MFR of resin component (190° C., 2.16 kg) [g/10 min] | 4.1 | 4.1 | 4.1 | 4.1 | 4.1 |
| | | | | Slab harness [Shore D] | 63 | 63 | 64 | 65 | 67 |
| | Properties of golf ball | | | Temperature of die of extruder [° C.] | 210 | 210 | 210 | 210 | 210 |
| | | | | Interlayer distance of layered silicate in cover | 2.71 | 2.83 | 2.96 | 3.12 | 3.55 |
| | | | | Coefficient of repulsion | 100 | 101 | 102 | 103 | 105 |
| | | | | Durability | E | E | E | E | G |

Formulation: parts by mass

TABLE 3-2

| | | | | | Golf ball No. | | | | |
|---|---|---|---|---|---|---|---|---|---|
| | | | | | 6 | 7 | 8 | 9 | 10 |
| Cover | Formulation | Nanocomposite | | No. | 6 | 7 | 8 | 9 | 10 |
| | | | Layered silicate | Type | C18 | C18 | C18 | C18 | — |
| | | | | Amount relative to 100 parts by mass of resin component [parts by mass] | 10.0 | 15.0 | 2.0 | 2.0 | — |
| | | Titanium dioxide | | Amount relative to 100 parts by mass of resin component in nanocomposte [parts by mass] | 4 | 4 | 4 | 4 | 4 |
| | Properties | | | MFR of resin component (190° C., 2.16 kg) [g/10 min] | 4.1 | 4.1 | 1.2 | 13 | 4.1 |
| | | | | Slab harness [Shore D] | 69 | 71 | 65 | 63 | 63 |
| | Properties of golf ball | | | Temperature of die of extruder [° C.] | 210 | 210 | 210 | 210 | 210 |
| | | | | Interlayer distance of layered silicate in cover | 3.83 | 3.92 | 14.9 | 2.61 | — |
| | | | | Coefficient of restitution | 107 | 109 | 104 | 100 | 98 |
| | | | | Durability | G | F | G | E | G |

Formulation: parts by mass

TABLE 3-3

| | | | | | Golf ball No. | | |
|---|---|---|---|---|---|---|---|
| | | | | | 11 | 12 | 13 |
| Cover | Formulation | Nanocomposite | | No. | 11 | 12 | 13 |
| | | | Layered silicate | Type | Mon | C18 | C18 |
| | | | | Amount relative to 100 parts by mass of resin component [parts by mass] | 2.0 | 2.0 | 2.0 |
| | | Titanium dioxide | | Amount relative to 100 parts by mass of resin component in nanocomposte [parts by mass] | 4 | 4 | 4 |
| | Properties | MFR of resin component (190° C., 2.16 kg) [g/10 min] | | | 4.1 | 0.9 | 20 |
| | | Slab harness [Shore D] | | | 63 | 65 | 65 |
| | Properties of golf ball | | | Temperature of die of extruder [° C.] | 210 | 210 | 210 |
| | | | | Interlayer distance of layered silicate in cover | 1.02 | >15 | 2.11 |
| | | | | Coefficient of restitution | 99 | 99 | 94 |
| | | | | Durability | P | F | P |

Formulation: parts by mass

The covers of golf balls No. 1 to 9 each contain an ionomer resin and an organically modified layered silicate which has an interlayer distance, measured by X-ray diffraction, in a range from 2.5 nm to 15 nm. Resilience and durability of all these golf balls are superior to that of golf ball No. 10 in which the cover does not contain an organically modified layered silicate. It is obvious that golf ball No. 7 has slightly inferior durability due to the large amount of the organically modified layered silicate contained.

Golf ball No. 11 has a cover which contains a layered silicate that is not organically modified, and it is obvious that golf ball No. 11 has inferior durability when compared to golf ball No. 10.

Golf ball No. 12 has a cover that contains an organically modified layered silicate having an interlayer distance, measured by X-ray diffraction, of more than 15 nm. In other words, it is a case in which the organically modified layered silicate is separated. It is obvious that golf ball No. 12 has inferior durability when compared to golf ball No. 10. Note that the reason why the organically modified layered silicate is separated in golf ball No. 12 may be that the melt flow rate of the ionomer resin used therein was small, so that the viscosity of the resin was high during mixing even under a temperature condition similar to those for golf balls No. 1 to 9, and therefore, an excessive shear force was applied to the organically modified layered silicate.

Golf ball No. 13 has a cover that contains an organically modified layered silicate having an interlayer distance, measured by X-ray diffraction, of less than 2.5 nm, and it is obvious that golf ball No. 13 has inferior durability when compared to golf ball No. 10. Note that the reason why the interlayer distance of the organically modified layered silicate was not increased to 2.5 nm or more in golf ball No. 13 may be that the melt flow rate of the ionomer resin used therein was large, so that the viscosity of the resin was low during mixing even under a temperature condition similar to those for golf balls No. 1 to 9, and therefore, the shear force during mixing was not enough to insert the ionomer resin into the interlayers of the organically modified layered silicate.

The present invention is useful as a golf ball having excellent durability and resilience. This application is based on Japanese Patent application No. 2008-110385 filed on Apr. 21, 2008, the contents of which are hereby incorporated by reference.

The invention claimed is:

1. A golf ball comprising a core and a cover covering the core, wherein the cover contains an ionomer resin and an organically modified layered silicate, and the organically modified layered silicate has an interlayer distance, measured by X-ray diffraction after molding into the cover, in a range from 2.5 nm to 15 nm.

2. The golf ball according to claim 1, wherein the organically modified layered silicate has an interlayer distance, measured by X-ray diffraction, in a range from 2.6 nm to 14.5 nm.

3. The golf ball according to claim 1, wherein the organically modified layered silicate has an interlayer distance, measured by X-ray diffraction, in a range from 2.7 nm to 14.0 nm.

4. The golf ball according to claim 1, wherein the ionomer resin has a melt flow rate (190° C., 2.16 kg) in a range from 0.5 g/10 min to 15 g/10 min.

5. The golf ball according to claim 1, wherein the ionomer resin has a melt flow rate (190° C., 2.16 kg) in a range from 2.0 g/10 min to 13 g/10 min.

6. The golf ball according to claim 1, wherein the content of the organically modified layered silicate in the cover is in a range from 0.01 part by mass to 10 parts by mass with respect to 100 parts by mass of the ionomer resin.

7. The golf ball according to claim 1, wherein the organically modified layered silicate is a layered silicate organically modified by an organic ammonium ion.

8. The golf ball according to claim 7, wherein the layered silicate is at least one selected from a smectite group consisting of montmorillonite, beidellite, nontronite, saponite, ferrous saponite, hectorite, sauconite, and stevensite.

9. The golf ball according to claim 1, wherein the cover has a slab hardness in Shore D Hardness in a range from 40 to 80.

10. A golf ball comprising a core and a cover covering the core, wherein the cover contains an ionomer resin having a melt flow rate (190° C., 2.16 kg) in a range from 0.5 g/10 min to 15 g/10 min, and an organically modified layered silicate which is obtained by modifying a layered silicate selected from a smectite group consisting of montmorillonite, beidellite, nontronite, saponite, ferrous saponite, hectorite, sauconite, and stevensite by an organic ammonium ion and which has an interlayer distance, measured by X-ray diffraction after molding into the cover, in a range from 2.5 nm to 15 nm.

11. A method for producing a golf ball, comprising the steps of:

organically modifying a layered silicate by an organic cation to produce an organically modified layered silicate;

mixing the organically modified layered silicate and the ionomer resin to prepare a nanocomposite having an interlayer distance in a range from 2.0 nm to 15 nm before the coverforming step; and forming a cover such that the organically modified layered silicate in the cover has an interlayer distance, measured by X-ray diffraction after molding into the cover, in a range from 2.5 nm to 15 nm, by using nanocomposite and an additive.

12. The method according to claim 11, wherein the organically modified layered silicate and the ionomer resin are mixed by using a twin screw extruder at the mixing step, under a mixing condition of a mixing temperature in a range from 140° C. to 220° C.

13. The method according to claim 11, wherein at the cover forming step, the nanocomposite and the additive are mixed and injection-molding of the cover is conducted, both by using a twin-screw extruder at a mixing temperature in a range from 140° C. to 220° C.

* * * * *